US009303893B2

(12) United States Patent
Miwa

(10) Patent No.: US 9,303,893 B2
(45) Date of Patent: Apr. 5, 2016

(54) OUTDOOR UNIT OF AIR-CONDITIONING APPARATUS

(71) Applicant: Mitsubishi Electric Corporation, Tokyo (JP)

(72) Inventor: Masaharu Miwa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/020,956

(22) Filed: Sep. 9, 2013

(65) Prior Publication Data

US 2014/0091692 A1 Apr. 3, 2014

(30) Foreign Application Priority Data

Oct. 1, 2012 (JP) ..... 2012-219590

(51) Int. Cl.
*F24F 13/20* (2006.01)
*F24F 1/56* (2011.01)

(52) U.S. Cl.
CPC .. *F24F 13/20* (2013.01); *F24F 1/56* (2013.01)

(58) Field of Classification Search
CPC ..... F24F 1/56; F24F 13/20
USPC ..... 312/100, 223.2, 257.1, 263, 265.5, 312/265.6; 361/724
See application file for complete search history.

(56) References Cited

U.S. PATENT DOCUMENTS

| | | | | |
|---|---|---|---|---|
| 3,105,726 | A * | 10/1963 | Jung | 312/195 |
| 5,975,659 | A * | 11/1999 | Yang et al. | 312/223.2 |
| 6,250,727 | B1 * | 6/2001 | Kan et al. | 312/223.2 |
| 7,142,431 | B2 * | 11/2006 | Li et al. | 361/726 |

FOREIGN PATENT DOCUMENTS

| | | | |
|---|---|---|---|
| CN | 203533740 | U | 4/2014 |
| JP | H05-133563 | A | 5/1993 |
| JP | H07-139762 | A | 5/1995 |
| JP | 2005-180793 | A | 7/2005 |
| JP | 2006-242544 | A | 9/2006 |
| JP | 2010-210097 | A | 9/2010 |

OTHER PUBLICATIONS

Office Action mailed Nov. 25, 2014 issued in corresponding JP patent application No. 2012-219590 (and English translation).
Office Action mailed Jul. 7, 2015 issued in corresponding JP patent application No. 2012-219590 (and English translation).
Office Action Issued Sep. 21, 2015 in the Corresponding CN application No. 201310446859.0 (with English translation).

* cited by examiner

*Primary Examiner* — James O Hansen
(74) *Attorney, Agent, or Firm* — Posz Law Group, PLC

(57) ABSTRACT

A casing 10 is included. The casing 10 includes a left side face panel 4 constituting one side face portion of the casing 10 and a part of a front face portion of the casing 10 adjacent to the side face portion, a front face left side panel 2 constituting the front face portion of the casing 10 together with the left side face panel 4, and the top face panel 7 constituting a top face portion of the casing 10. The front face left side panel 2 includes a temporary fixing stop portion 2*a* at an upper end portion. The temporary fixing stop portion 2*a* projects toward a back side of the casing 10. The left side face panel 4 includes a temporary fixing rectangular hole 4*a* at an upper end portion of a front face side. The temporary fixing stop portion 2*a* is inserted into the temporary fixing rectangular hole 4*a*. The front face left side panel 2 and the left side face panel 4 are fixed on the front face side of the casing 10. The temporary fixing stop portion 2*a* and the temporary fixing rectangular hole 4*a* are covered by the top face panel 7.

7 Claims, 6 Drawing Sheets

OUTDOOR UNIT OF AIR-CONDITIONING APPARATUS

TECHNICAL FIELD

The present invention relates to an outdoor unit of an air-conditioning apparatus.

BACKGROUND ART

In recent years, a split type air-conditioning apparatus with high performance and large capacity has become widely used. The split type air-conditioning apparatus includes an indoor unit and an outdoor unit. With the improved performance and power of the split type air-conditioning apparatus, the casing of the outdoor unit has become larger.

Among split type air-conditioning apparatuses, there is an apparatus with a large front face left side panel constituting a casing of the outdoor unit. As an example of such an apparatus, there is a split type air-conditioning apparatus with improved ease of assembly, in which "a supporting stop 49 of a front panel 31 is inserted into a supporting hole 53 of a baffle plate 37 so as to lock a locking projection 51 to the baffle plate 37", "the front panel 31 is turned around the supporting stop 49 as a turning center to move an edge portion 55 on the left side close to the outdoor unit 5", and a temporary stop 57 of the front panel 31 is temporarily fixed to a heat exchanging side plate 39 (see, for example, Patent Literature 1).

CITATION LIST

Patent Literature

[Patent Literature 1] Japanese Unexamined Patent Application Publication No. 2006-242544 (paragraph [0024] and FIG. 2)

SUMMARY OF INVENTION

Technical Problem

In the split type air-conditioning apparatus disclosed in Patent Literature 1, the front panel (a front face panel) is fixed to portions of the baffle plate and the heat exchanging side plate (a side face panel) that are on a side of the casing that is not exposed after the casing has been assembled. As a result, a design surface of the outdoor unit exposed after the casing has been assembled is not damaged by the supporting stop of the front panel and the temporary stop.

However, if a portion where the front face panel and the side face panel are coupled is located on a lateral side of the casing, this makes it difficult to ascertain the position of the portion where the front face panel and the side face panel are coupled. Thus, there is a problem that the positioning of the front face panel is difficult.

If the portion where the front face panel and the side face panel are coupled is located at a front face side of the casing, there is a problem that a stop portion disposed on the front face panel possibly damages the design surface of the outdoor unit exposed after the casing has been assembled.

The present invention has been made in view of the above-described problems as background, and an aim thereof is to obtain an outdoor unit of an air-conditioning apparatus that allows easy positioning of a front face panel and that inhibits a design surface exposed after the casing has been assembled from being damaged.

Solution to Problem

An outdoor unit of an air-conditioning apparatus according to the present invention includes a casing having a side face panel, a front face panel, and a top face panel. The side face panel constitutes one side face portion of the casing and a part of a front face portion of the casing adjacent to the side face portion. The front face panel constitutes the front face portion of the casing together with the side face panel. The top face panel constitutes a top face portion of the casing. The front face panel includes, at an upper end portion thereof, a temporary fixing stop portion. The temporary fixing stop portion projects toward a back side of the casing. The side face panel includes a temporary fixing hole at an upper end portion of a front face side. The temporary fixing stop portion is inserted into the temporary fixing hole. The side face panel and the front face panel are fixed on the front face side of the casing. The temporary fixing stop portion and the temporary fixing hole are covered by the top face panel.

Advantageous Effects of Invention

According to the present invention, the portion where the front face panel and the side face panel are coupled is located at the front face side of the casing. This allows positioning of the front face panel with ease.

Additionally, with the present invention, the front face panel is fixed to the side face panels on a non-design surface of the outdoor unit that is not exposed after the casing has been assembled. This inhibits the design surface of the outdoor unit exposed after the casing has been assembled from being damaged, and helps maintain the quality at the time of assembly of the outdoor unit.

DESCRIPTION OF EMBODIMENTS

Embodiment 1

Figure 1:
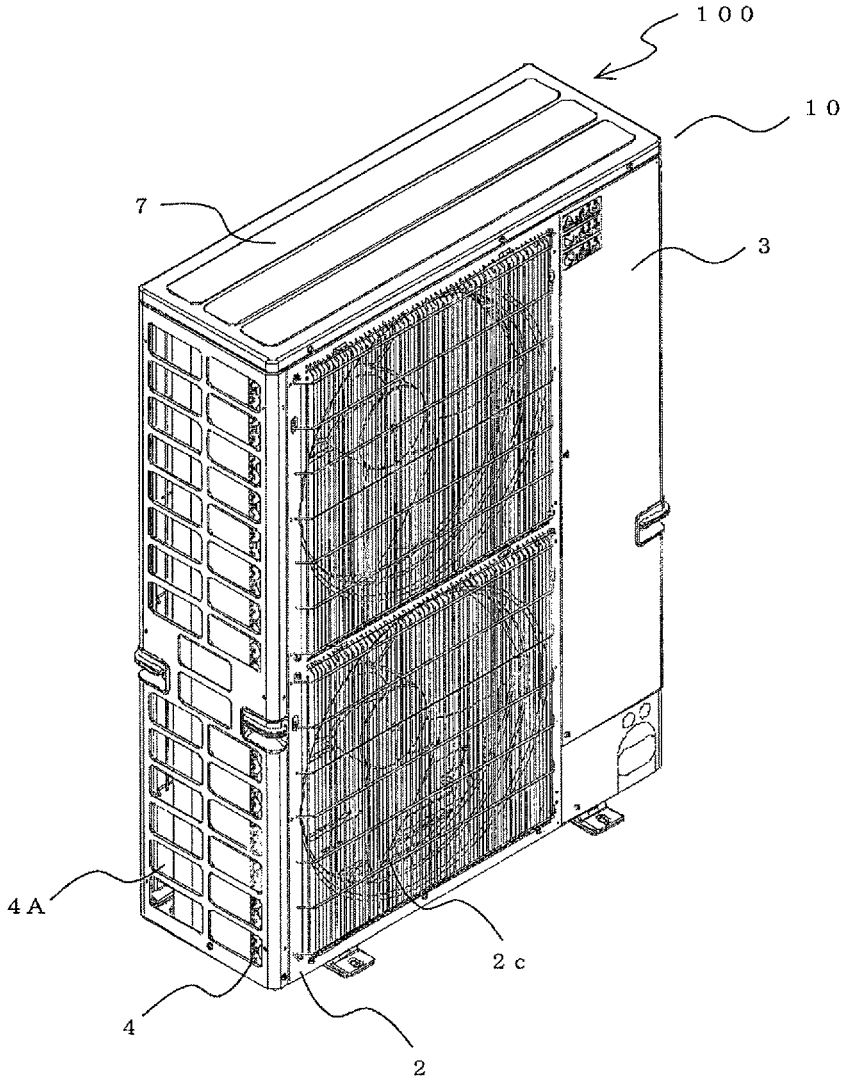
FIG. 1 is a perspective view of a front face side of an outdoor unit of an air-conditioning apparatus according to Embodiment 1 of the present invention.
Figure 2:
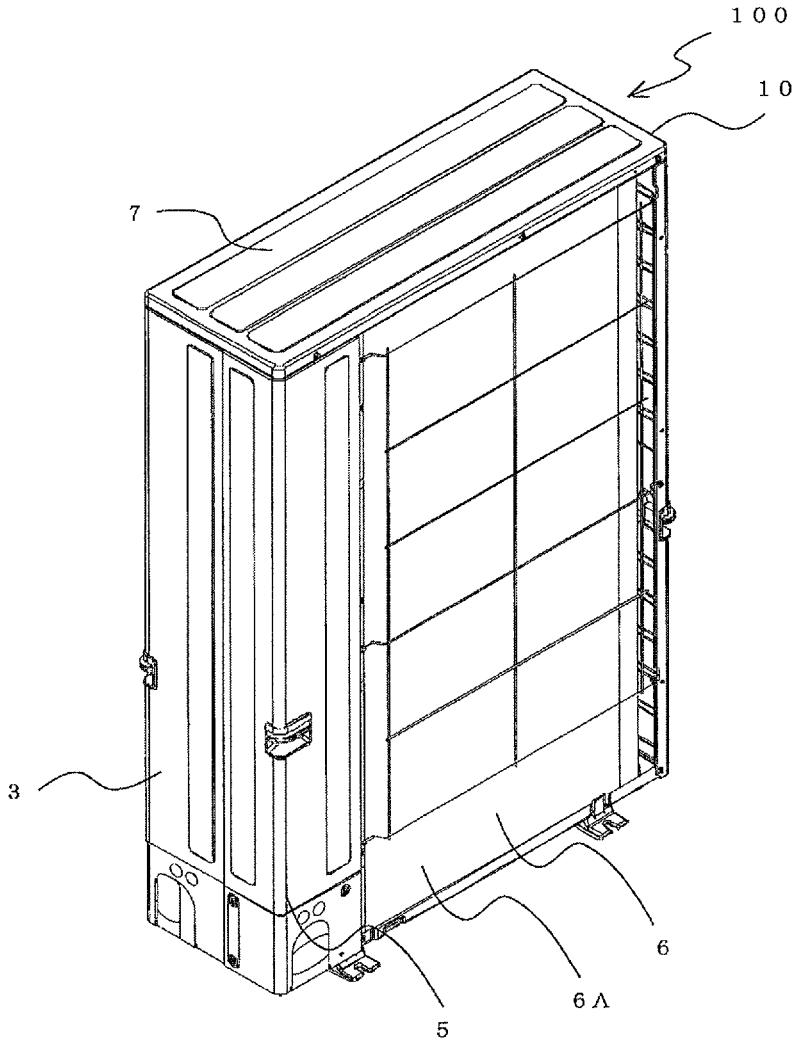
FIG. 2 is a perspective view of a back side of the outdoor unit of the air-conditioning apparatus according to Embodiment 1 of the present invention.
Figure 3:
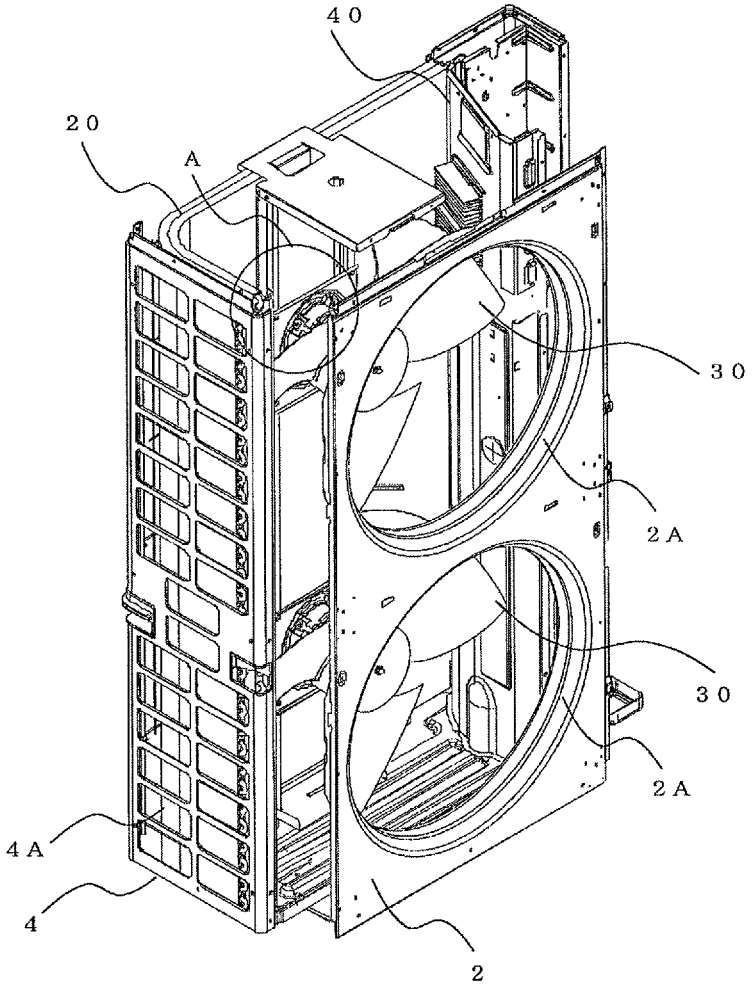
FIG. 3 is a panel layout view of the outdoor unit of the air-conditioning apparatus according to Embodiment 1 of the present invention.

FIG. 1 is a perspective view of a front face side of an outdoor unit 100 of an air-conditioning apparatus according to Embodiment 1 of the present invention. FIG. 2 is a perspective view of a back side of the outdoor unit 100 of the air-conditioning apparatus according to Embodiment 1 of the present invention. FIG. 3 is a panel layout view of the outdoor unit 100 of the air-conditioning apparatus according to Embodiment 1 of the present invention.

As shown in FIG. 1 and FIG. 2, the outdoor unit 100 includes a compressor (not shown), a heat exchanger 20 (described below), and a casing 10 that has an approximately rectangular parallelepiped shape constituting an exterior wall of the outdoor unit 100. The casing 10 includes a front face left side panel 2, a front face right side panel 3, a left side face panel 4, a back face right side panel 5, a back face left side panel 6, a top face panel 7, and a bottom face panel (not shown). The panels, which are formed of, for example, a metal, constitute the casing 10.

As shown FIG. 1, the front face left side panel 2 includes a grid-like fan guard 2*c*, and constitutes a part of a front face portion of the casing 10. As shown in FIG. 3, air outlets 2A are formed at the upper and lower portions of the front face left side panel 2. The air outlets 2A are each approximately a circular-shaped opening portion. As shown in FIG. 1, the front face right side panel 3 constitutes a part of the front face portion and a right side face portion of the casing 10.

As shown in FIG. 1, air inlets 4A are formed on the left side face panel 4 in rows of two. The rows are located side by side and each row has plural air inlets. The air inlet 4A is, for example, an elliptically shaped opening portion. The air inlet 4A communicates with the inside of the outdoor unit 100 and the outside of the outdoor unit 100. The left side face panel 4 constitutes a part of the front face portion and a left side-face portion of the casing 10. While the example where the air inlets 4A are formed in rows of two is described, the number of rows and the number of opening portions per row are not limited to this.

As shown in FIG. 2, the back face right side panel 5 constitutes a part of the back side of the casing 10. The back face left side panel 6 has an air inlet 6A, which is an opening portion, and constitutes a part of the back face portion of the casing 10. The air inlet 6A communicates with the inside of the outdoor unit 100 and the outside of the outdoor unit 100.

As shown in FIG. 1 and FIG. 2, the top face panel 7 constitutes a top face portion of the casing 10. When the top face panel 7 is assembled, upper end portions of the front face left side panel 2, the front face right side panel 3, the left side face panel 4, the back face right side panel 5, and the back face left side panel 6 are covered. The covered portion becomes a non-design surface of the outdoor unit 100 that is not exposed after the casing 10 has been assembled.

The front face left side panel 2 corresponds to a front face panel in the present invention.

The left side face panel 4 corresponds to a side face panel in the present invention.

As shown in FIG. 3, the heat exchanger 20, a fan 30, and a divider plate 40 are disposed inside the outdoor unit 100.

The heat exchanger 20 is formed in an approximately L shape along with, for example, a left side face side and a back side of the outdoor unit 100. The heat exchanger 20 includes, for example, a heat-transfer pipe (not shown) and a plurality of fins (not shown) disposed at predetermined spacing. The heat exchanger 20 is coupled to a refrigerant pipe, and constitutes a part of a refrigerant circuit.

The fans 30 are respectively disposed at the upper and lower positions in, for example, the outdoor unit 100, and are positioned on the front face side of the outdoor unit 100 with respect to the heat exchanger 20. When operation of the fan 30 is started, outside air is sucked inside the outdoor unit 100 from the air inlet 4A of the left side face panel 4 and the air inlet 6A of the back face left side panel 6, and passes through the heat exchanger 20 and the fan 30 in this order. The outside air, which passed through the fan 30, passes through the air outlet 2A of the front face left side panel 2, and is blown out to the outside of the outdoor unit 100.

The divider plate 40 is a plate with rigidity and divides the inside of the outdoor unit 100 into a heat exchange chamber and a machine room. The heat exchanger 20 and the fan 30 are disposed in the heat exchange chamber. The compressor (not shown), an electric component box (not shown) and the like are disposed in the machine room.

Figure 4:
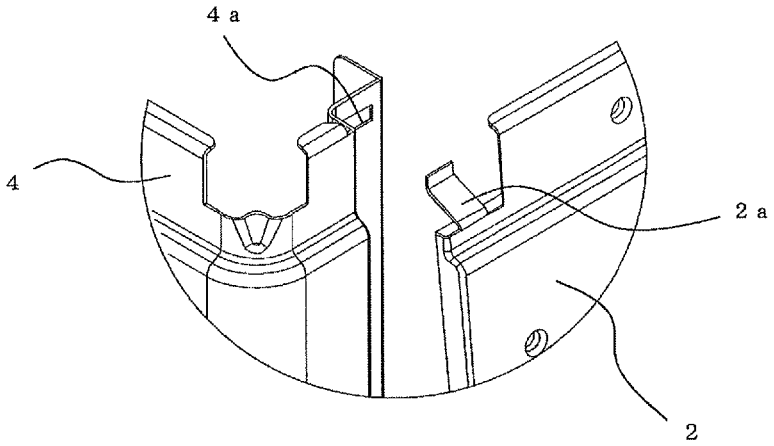
FIG. 4 is a partially enlarged view of a main part of an A part of FIG. 3.
Figure 5:
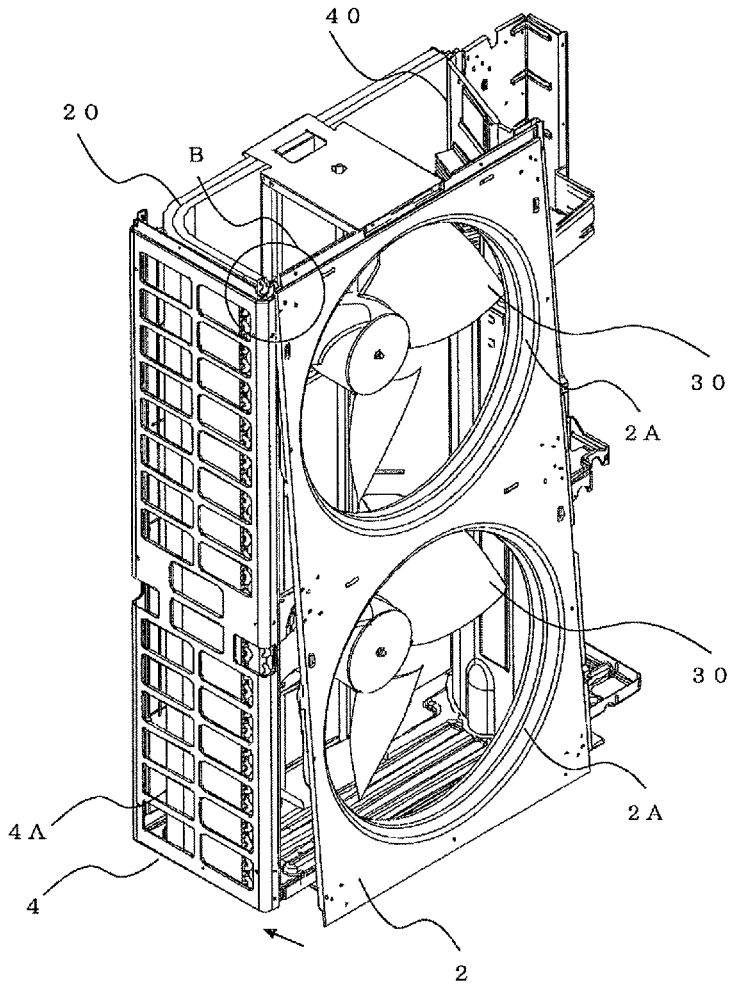
FIG. 5 is a panel mount diagram of the outdoor unit of the air-conditioning apparatus according to Embodiment 1 of the present invention.
Figure 6:
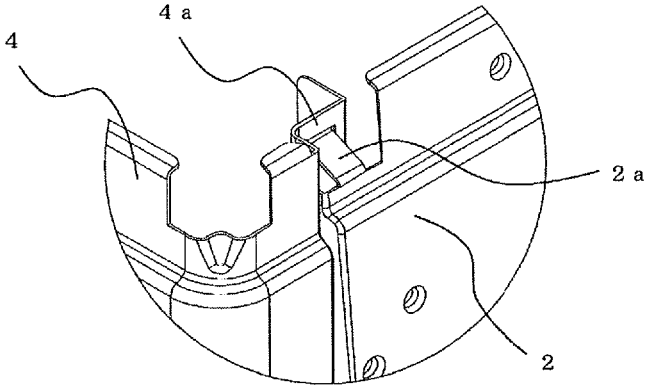
FIG. 6 is a partially enlarged view of a main part of a B part of FIG. 5.

FIG. 4 is a partially enlarged view of a main part of part A of FIG. 3. FIG. 5 is a panel mount diagram of the outdoor unit 100 of the air-conditioning apparatus according to Embodiment 1 of the present invention. FIG. 6 is a partially enlarged view of a main part of part B of FIG. 5.

Here, a description will be given of a structure for temporarily fixing the front face left side panel 2 and the left side face panel 4 on the non-design surface of the outdoor unit 100 that is not exposed after the casing 10 has been assembled. The non-design surface of the outdoor unit 100 is the upper end portion of the left side face panel 4.

As shown in FIG. 4, a temporary fixing stop portion 2*a* that allows temporary fixing for the purpose of positioning and projects toward the back side of the casing 10 is disposed on the upper end portion of the front face left side panel 2. A temporary fixing rectangular hole 4*a* for positioning is disposed at the upper end portion on the front face side of the left side face panel 4.

In a state shown in FIG. 4, when the temporary fixing stop portion 2*a* of the front face left side panel 2 is inserted into the temporary fixing rectangular hole 4*a* of the left side face panel 4 and is locked, as shown in FIG. 5 and FIG. 6, the front face left side panel 2 and the left side face panel 4 are temporarily fixed in place. As shown in FIG. 1 and FIG. 2, after the outdoor unit 100 has been assembled, the front face left side panel 2 and the upper end portion of the left side face panel 4 are covered by the top face panel 7. Therefore, the temporary fixing stop portion 2*a* and the temporary fixing rectangular hole 4*a* are not exposed.

Figure 7:
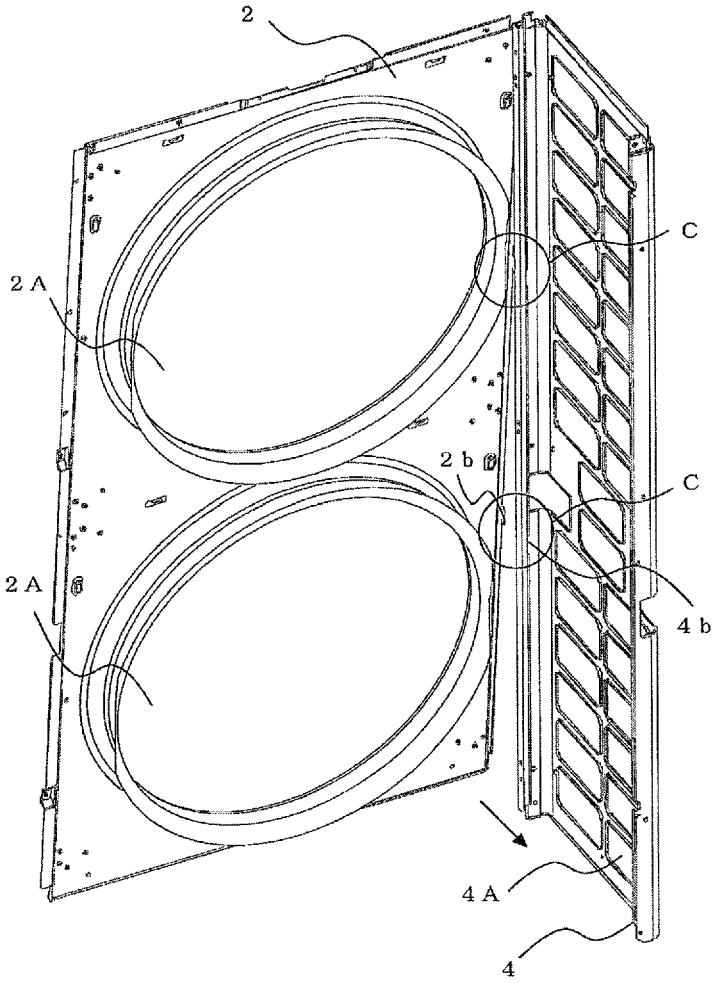
FIG. 7 is a panel mount diagram of the outdoor unit of the air-conditioning apparatus according to Embodiment 1 of the present invention.
Figure 8:
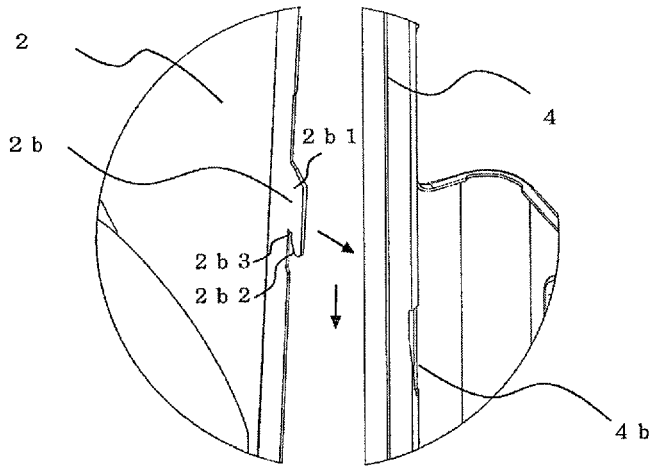
FIG. 8 is a partially enlarged view of a main part of a C part of FIG. 7.

FIG. 7 is a panel mount diagram of the outdoor unit 100 of the air-conditioning apparatus according to Embodiment 1 of the present invention. FIG. 8 is a partially enlarged view of a main part of part C of FIG. 7.

Figure 9:
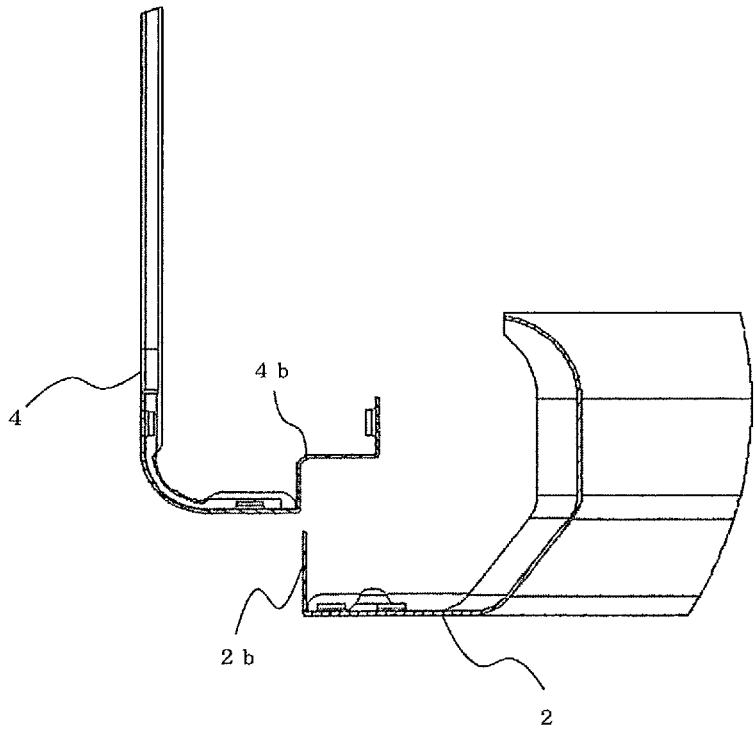
FIG. 9 is a plan view of a front face left side panel and a left side face panel of the outdoor unit of the air-conditioning apparatus according to Embodiment 1 of the present invention.

FIG. 9 is a plan view of the front face left side panel 2 and the left side face panel 4 of the outdoor unit 100 of the air-conditioning apparatus according to Embodiment 1 of the present invention.

Here, a description will be given of a structure for fixing finally the front face left side panel 2 and the left side face panel 4, which is performed after temporary fixation described above. The final fixation is performed on the lower side of the temporary fixing rectangular hole 4*a* in the left side face panels 4.

As shown in FIG. 7 to FIG. 9, a final fixing stop portion 2*b* that allows fixing finally is disposed on the back surface of the front face left side panel 2. The final fixing stop portion 2*b* projects toward the back side of the casing 10. In the left side face panels 4, a final fixing rectangular hole 4*b* is disposed on the same surface as the surface where the temporary fixing rectangular hole 4*a* is disposed. The final fixing stop portion 2*b* is inserted into the final fixing rectangular hole 4*b*. The final fixing stop portion 2*b* is positioned below the temporary fixing stop portion 2*a*. The final fixing rectangular hole 4*b* is positioned below the temporary fixing rectangular hole 4*a*.

The final fixing stop portion 2*b* includes inclined portions 2*b*1 and 2*b*2 and a groove portion 2*b*3. The inclined portion 2*b*1 is formed at the upper end portion of the final fixing stop portion 2*b*. The inclined portion 2*b*1 inclines downward from a base end of the final fixing stop portion 2*b* (the front face side of the casing 10) toward a distal end (the back side of the casing 10). The inclined portion 2*b*2 is formed at the lower end portion of the final fixing stop portion 2*b*. The inclined portion 2*b*2 is inclined from the base end of the final fixing stop portion 2*b* (the front face side of the casing 10) toward the distal end (the back side of the casing 10). The groove portion 2*b*3 is formed at the lower end portion of the final fixing stop portion 2*b*. The groove portion 2*b*3 is formed from the base end portion of the final fixing stop portion 2*b* toward the portion at the most base end side of the inclined portion 2*b*2. The groove portion 2*b*3 has a shape hollowed from the lower end of the final fixing stop portion 2*b* toward the upper side.

When the aforementioned temporary fixation is made, an operator turns the front face left side panel 2 around a portion where the temporary fixing stop portion 2*a* is inserted into the temporary fixing rectangular hole 4*a* as a turning center. The final fixing stop portion 2*b* of the front face left side panel 2 is moved close to the final fixing rectangular hole 4*b* of the left side face panel 4. Then, the final fixing stop portion 2*b* is guided and inserted into the final fixing rectangular hole 4*b*. The final fixing stop portion 2*b* drops by its own weight, and is locked in the final fixing rectangular hole 4*b*. Thus, the front face left side panel 2 and the left side face panel 4 are finally fixed in place. Accordingly, the operator turns the front face left side panel 2, which is positioned by temporary fixation and stabilized, and can insert the final fixing stop portion 2*b* into the final fixing rectangular hole 4*b* and lock. Hence, the operator can easily perform the final fixation.

The final fixing stop portion 2*b* includes the inclined portions 2*b*1 and 2*b*2, which are inclined downward toward the distal end (the back side of the casing 10). Hence, when the front face left side panel 2 is turned around a position where the temporary fixing stop portion 2*a* is locked in the temporary fixing rectangular hole 4*a* as a turning center, the final fixing stop portion 2*b* is easily inserted into the final fixing rectangular hole 4*b*.

The final fixing stop portion 2*b* includes the groove portion 2*b*3, which is hollowed from the lower end of the final fixing stop portion 2*b* toward the upper side. Hence, after the final fixing stop portion 2*b* is inserted into the final fixing rectangular hole 4*b*, the final fixing stop portion 2*b* drops by its own weight, and is easily locked in the final fixing rectangular hole 4*b*.

After the aforementioned final fixation is made, the assembly of the outdoor unit 100 may be completed by fixing respective panels to one another by, for example, using screws or a similar method.

As described above, in the outdoor unit 100 of the air-conditioning apparatus according to Embodiment 1, the left side face panel 4 and the front face left side panel 2 are fixed on the front face side of the casing 10. As a result, the front face left side panel 2 can be easily positioned.

The temporary fixing stop portion 2*a*, which projects toward the back side of the casing 10, is disposed on the upper end portion of the front face left side panel 2. The temporary fixing rectangular hole 4*a*, into which the temporary fixing stop portion 2*a* is inserted, is disposed at the upper end portion on the front face side of the left side face panel 4. The temporary fixing stop portion 2*a* and the temporary fixing rectangular hole 4*a* are covered by the top face panel. In view of this, the front face left side panel 2 is fixed to the left side face panels 4 on the non-design side of the outdoor unit 100 that is not exposed in the left side face panels 4 after the casing 10 has been assembled. Accordingly, the design surface of the outdoor unit 100 that is exposed after the casing 10 has been assembled can be suppressed from being damaged, and the quality at the time of assembly of the outdoor unit 100 is maintained.

In the outdoor unit 100 of the air-conditioning apparatus according to Embodiment 1, the final fixing stop portion 2*b* projecting toward the back side of the casing 10 is disposed on the front face left side panel 2 and the final fixing rectangular hole 4*b* is disposed on the left side face panel 4 such that the final fixing stop portion 2*b* is inserted into the final fixing rectangular hole 4*b* when the front face left side panel 2 is turned in a state where the temporary fixing stop portion 2*a* is inserted into the temporary fixing rectangular hole 4*a*.

In view of this, after temporary fixation has been performed, when the operator turns the front face left side panel 2 around a position where the temporary fixing stop portion 2*a* is locked in the temporary fixing rectangular hole 4*a* as a turning center, the final fixing stop portion 2*b* of the front face left side panel 2 is moved close to the final fixing rectangular hole 4*b* of the left side face panel 4. Then, the final fixing stop portion 2*b* is guided and inserted into the final fixing rectangular hole 4*b*. The final fixing stop portion 2*b* drops by its own weight, and is locked in the final fixing rectangular hole 4*b*. Thus, the front face left side panel 2 and the left side face panel 4 are finally fixed in place.

Accordingly, the operator turns the front face left side panel 2, which is positioned by the temporary fixation and stabilized, and can insert the final fixing stop portion 2*b* into the final fixing rectangular hole 4*b* and lock. Hence, the operator can easily perform the final fixation.

In Embodiment 1, the fixation of the front face left side panel 2 and the left side face panel 4 is described, but is not limited to this.

For example, in the case where the fan 30 is disposed on the right side of the outdoor unit 100, the outdoor unit 100 may be assembled by fixing temporarily and finally a panel constituting a part of the front face side of the casing 10 disposed facing the fan 30 and a panel constituting a part of the front face side and a right side-face side of the casing 10.

In Embodiment 1, an example of fixing the front face left side panel 2 and the left side face panel 4 on the front face side of the casing 10 is described, but is not limited to this. When two panels are fixed on the back side of the casing 10, the panels may be temporarily and finally fixed in place with: a temporary fixing stop portion and a final fixing stop portion on one panel; and a temporary fixing rectangular hole and a final fixing rectangular hole on the other panel.

In Embodiment 1, the example where the temporary fixing rectangular hole 4*a* is disposed is described, but is not limited to this. As long as the shape allows the temporary fixing stop portion 2*a* to be inserted and also allows the front face left side panel 2 to turn in a state where the temporary fixing stop portion 2*a* is inserted into the temporary fixing rectangular hole 4*a*, another shape such as a trapezoid hole can be employed.

In Embodiment 1, the example where the final fixing rectangular hole 4*b* is disposed is described, but is not limited to this. As long as the shape allows the final fixing stop portion 2*b* to be inserted, another shape such as a trapezoid can be employed.

In Embodiment 1, the example where the temporary fixing stop portion 2*a* is disposed on the front face left side panel 2 and the temporary fixing rectangular hole 4*a* is disposed on the left side face panel 4 is described, but the arrangement is not limited to this. For example, the temporary fixing rectangular hole 4*a* may be disposed on the front face left side panel 2, and the temporary fixing stop portion 2*a* may be disposed on the left side face panel 4. In this case, the shape of the temporary fixing stop portion 2*a* has to be a shape that allows the temporary fixing stop portion 2*a* to be locked in the temporary fixing rectangular hole 4*a*.

REFERENCE SIGNS LIST

2 front face left side panel, 2A: air outlet, 2*a* temporary fixing stop portion, 2*b* final fixing stop portion, 2*b*1, 2*b*2 inclined portion, 2*b*3 groove portion, 2*c* fan guard, 3 front face right side panel, 4 left side face panel, 4A air inlet, 4*a* temporary fixing rectangular hole, 4*b* final fixing rectangular hole, 5 back face right side panel, 6 back face left side panel, 6A air inlet, 7 top face panel, 10 casing, 20 heat exchanger, 30 fan, 40 divider plate, 100 outdoor unit

The invention claimed is:

1. An outdoor unit of an air-conditioning apparatus, comprising a casing, wherein the casing includes:

a side face panel constituting one side face portion of the casing and a part of a front face portion of the casing adjacent to the side face portion;

a front face panel constituting the front face portion of the casing together with the side face panel; and a top face panel constituting a top face portion of the casing, wherein a temporary fixing stop portion is formed at an upper end portion of the front face panel, the temporary fixing stop portion projecting toward a back side of the casing, an upper end portion of a front face side of the side face panel includes a temporary fixing hole into which the temporary fixing stop portion is inserted, the side face panel and the front face panel are fixed on the front face side of the casing, and the temporary fixing stop portion and the temporary fixing hole are covered by the top face panel when viewed from a front of the casing, the temporary fixing stop portion of the front face panel has a bent end inserted into and through the temporary fixing hole of the side face panel, the bent end is located above a base end of the temporary fixing stop portion, the temporary fixing stop portion and the temporary fixing hole have cooperating structures and dimensions positioning and orienting the front face panel to turn in a gravitational direction, when the temporary fixing stop portion is arranged within the temporary fixing hole, the temporary fixing stop portion has a size in lateral width matching the temporary fixing hole, the front face panel includes a final fixing stop portion that projects toward the back side of the casing, the final fixing stop portion including a groove in the lower part to fit an edge of a final fixing hole and the side face panel includes the final fixing hole configured to receive insertion of the final fixing stop portion when the front face panel is turned in a state where the temporary fixing stop portion has been inserted into the temporary fixing hole.

2. The outdoor unit of the air-conditioning apparatus of claim 1, wherein the temporary fixing stop portion and the temporary fixing hole have cooperating structures and dimensions positioning and orienting the front face panel to turn in a gravitational direction, when the temporary fixing stop portion is arranged within the temporary fixing hole.

3. The outdoor unit of the air-conditioning apparatus of claim 1, wherein the temporary fixing hole and the temporary fixing stop portion have matching shapes that position and stabilize the front face panel relative to the side face panel.

4. The outdoor unit of the air-conditioning apparatus of claim 1, wherein the bent end of the temporary fixing stop portion of the front face panel is inserted into and past the temporary fixing hole of the side panel with the front face panel arranged at an angle relative to the side panel, and after insertion the front face panel is turned to another angle relative to the side panel to position and stabilize the front face panel relative to the side face panel.

5. A casing for an outdoor unit of an air-conditioning apparatus, comprising:

a top face portion, a front face portion, a back face portion, two side face portions and a bottom portion;

a top face panel covering the top face portion of the casing;

a front face panel covering a part of the front face portion of the casing, an upper portion of the front face panel having an assembly fixing projection extending at an angle from the front face panel and projecting toward the back face portion of the casing;

a side panel covering one of the two side face portions and a part of the front face portion of the casing, an upper end portion of the part of the side panel covering the front face portion of the casing including an assembly fixing hole, the assembly fixing hole removably receiving the assembly fixing projection of the front face panel, wherein the assembly fixing hole is an elongated opening having a longer axis extending between the left and right side face portions of the casing, the assembly fixing projection has a bent distal end located above a base end of the assembly fixing projection and a cross-sectional area matching the elongated opening of the assembly fixing hole, and the bent distal end of the assembly fixing projection of the front face panel is inserted into and through the assembly fixing hole of the side panel, and the front face panel is held in position and stabilized relative to the side panel and the front face portion of the casing by orientation of the elongated opening of the assembly fixing hole with the matching cross-sectional area of the assembly fixing projection, wherein the top face panel extends downward beyond the assembly fixing projection and the assembly fixing hole, and the top face panel covers the assembly fixing projection and assembly fixing hole when viewed from a front of the casing, and the assembly fixing projection and the assembly fixing hole have cooperating structures and dimensions positioning and orienting the front face panel to turn in a gravitational direction, when the assembly fixing projection is arranged within the assembly fixing hole.

6. The casing for an outdoor unit of an air-conditioning apparatus of claim 5, further comprising:

another side panel covering a part of the front face and a part of another one of the two side face portions of the casing; and a back face panel covering a part of the back face portion and another part of the another one of the two side face portions of the casing.

7. The outdoor unit of the air-conditioning apparatus of claim 5, wherein the bent end of the assembly fixing projection of the front face panel is inserted into and passed the assembly fixing hole of the side panel with the front face panel arranged at an angle relative to the side panel, and after the insertion the front face panel is turned to another angle relative to the side panel to position and stabilize the front face panel relative to the side face panel.

* * * * *